US008622708B2

(12) United States Patent
Küsters et al.

(10) Patent No.: US 8,622,708 B2
(45) Date of Patent: Jan. 7, 2014

(54) STATOR BLADE FOR A TURBOMACHINE WHICH IS EXPOSABLE TO AXIAL THROUGHFLOW, AND ALSO STATOR BLADE ARRANGEMENT FOR IT

(75) Inventors: Bernhard Küsters, Jupiter, FL (US); Marc Mittelbach, Wuppertal (DE); Uwe Sieber, Mülheim an der Ruhr (DE); Ulrich Waltke, Mülheim an der Ruhr (DE); Dirk Wistuba, Mülheim an der Ruhr (DJ)

(73) Assignee: Siemens Aktiengesellschaft, München (DE)

( * ) Notice: Subject to any disclaimer, the term of this patent is extended or adjusted under 35 U.S.C. 154(b) by 749 days.

(21) Appl. No.: 12/868,946

(22) Filed: Aug. 26, 2010

(65) Prior Publication Data

US 2011/0052397 A1 Mar. 3, 2011

(30) Foreign Application Priority Data

Aug. 28, 2009 (EP) ..... 09011070

(51) Int. Cl.
*F04D 29/34* (2006.01)
*F03B 3/12* (2006.01)

(52) U.S. Cl.
USPC ..... 416/218; 416/220 R

(58) Field of Classification Search
USPC ..... 415/209.3; 416/215, 219 R, 220 R, 416/220 A, 219 A, 216, 204 A, 218
See application file for complete search history.

(56) References Cited

U.S. PATENT DOCUMENTS

| | | | | |
|---|---|---|---|---|
| 1,061,640 | A * | 5/1913 | Snyder | 416/218 |
| 3,252,687 | A * | 5/1966 | Beck et al. | 416/216 |
| 4,050,850 | A * | 9/1977 | Beckershoff | 416/221 |
| 4,645,425 | A * | 2/1987 | Morrison, Jr. | 416/215 |
| 5,713,721 | A * | 2/1998 | Glynn et al. | 416/220 R |
| 6,761,538 | B2 | 7/2004 | Fitts et al. | |
| 6,981,847 | B2 * | 1/2006 | Arinci et al. | 416/193 A |
| 7,467,925 | B2 * | 12/2008 | Schroder | 416/220 R |
| 7,862,246 | B2 * | 1/2011 | Terada | 400/76 |
| 2003/0185673 | A1 | 10/2003 | Matsumoto et al. | |
| 2004/0086387 | A1 | 5/2004 | Fitts et al. | |
| 2005/0191177 | A1 | 9/2005 | Anderson et al. | |
| 2009/0208332 | A1 * | 8/2009 | Weinstein et al. | 415/209.3 |

FOREIGN PATENT DOCUMENTS

| | | |
|---|---|---|
| EP | 0899426 A2 | 3/1999 |
| EP | 2093383 A1 | 8/2009 |

* cited by examiner

*Primary Examiner* — Nathaniel Wiehe
*Assistant Examiner* — Ryan Ellis

(57) ABSTRACT

A stator blade and a stator blade arrangement for a turbomachine which is exposable to axial throughflow is provided. Each stator blade is retained via a fixed clamping in a circumferential groove. For the fixed clamping, provision is made on one side of the blade root for a shaped piece with a threaded hole into which a tensioning screw, which is supported on the bottom of the circumferential groove, may be screwed.

13 Claims, 1 Drawing Sheet

STATOR BLADE FOR A TURBOMACHINE WHICH IS EXPOSABLE TO AXIAL THROUGHFLOW, AND ALSO STATOR BLADE ARRANGEMENT FOR IT

CROSS REFERENCE TO RELATED APPLICATIONS

This application claims priority of European Patent Office application No. 09011070.1 EP filed Aug. 28, 2009, which is incorporated by reference herein in its entirety.

FIELD OF INVENTION

The invention refers to a stator blade for a turbomachine which is exposable to axial throughflow, comprising a blade root, having two sides disposed opposite each other, with a platform and at least one blade airfoil which is arranged thereupon. In addition, the invention refers to a stator blade arrangement with a carrier structure, on the inner generated surface of which provision is made for a circumferential groove in which stator blades, which are retained by means of a form fit, are seated in a butt-mounted manner.

BACKGROUND OF INVENTION

Such a stator blade and stator blade arrangement for a compressor are known for example from US 2005/0191177 A1. In the compressor casing, which is formed by two halves of an annulus, provision is made for a circumferential groove for each stator blade ring of a compressor stage. The sidewalls of the circumferential groove have undercuts in order to retain in this groove, in a form-fitting manner by correspondingly formed inverted T-shaped blade roots, stator blades which are inserted therein. Two abutting stator blades in the circumferential groove have a hole in each case in their oppositely disposed side faces. A tensioning sleeve, for the mechanical coupling of the two directly adjacent blade roots, is inserted into the aligning holes. As a result of the coupling, blade vibrations are expected to be damped and blade root movements reduced or prevented, which as a result avoids wear on the blade roots.

In addition, a tensioned seating of rotor blades in an inverted T-shaped circumferential groove is known from U.S. Pat. No. 6,761,538 B2. For applying a tensioning force which acts upon the rotor blades in the radial direction, an encompassing channel is formed in the bottom of the circumferential groove, in which is inserted a spring ring which acts upon the rotor blade. The spring ring is designed in the form of a curved tensioning sleeve which, in addition to the customary longitudinal slot, also has a multiplicity of slots which extend in its circumferential direction, as a result of which free-ending spring arms, which are arranged in between them, are created, by means of which the rotor blades, which are inserted in the circumferential groove, are fastened in a tensioned manner in the radial direction.

SUMMARY OF INVENTION

The object of the invention is the disclosure of an alternative stator blade arrangement and the provision of a stator blade which is suitable for it.

The object which is focused upon the stator blade is achieved with a stator blade for a turbomachine which is exposable to axial throughflow, which comprises a blade root, having two oppositely disposed sides, with a platform and at least one blade airfoil which is arranged thereupon, wherein the blade root on one of the two sides has at least one projecting shaped piece in which provision is made for at least one threaded hole for the radial tensioning of the stator blade in a circumferential groove of a carrier structure of a turbomachine by means of a tensioning screw which is screwed in the threaded hole and supported on the bottom of the circumferential groove, and in which the blade root on the other of the two sides has at least one recess for accommodating at least one shaped piece of an adjacent stator blade, including a tensioning screw which is screwed into it.

The object which is focused upon the stator blade arrangement is achieved with an annular carrier structure, on the inner generated surface of which provision is made for a circumferential groove, in which stator blades according to the aforesaid development, which are retained by means of a form fit, are seated in an butt-mounted manner, wherein each such stator blade is tensioned in the circumferential groove by means of a tensioning screw which is screwed in the threaded hole of its shaped piece and supported on the bottom of the circumferential groove, and the shaped piece, including the tensioning screw, is fully covered by the platform of that stator blade which is directly adjacent to the stator blade in question.

As a result of the stator blade arrangement according to the invention, a fixed clamping in the radial direction of the stator blade in the carrier structure of a turbomachine which is exposable to axial throughflow can be achieved. Since the tensioning force is first created when screwing in and tightening up the tensioning screw, the stator blade, and particularly its blade root, can be produced with comparatively large tolerances and with comparatively low fitting accuracy in relation to the contour of the circumferential groove. On the one hand, this facilitates the positioning, i.e. inserting and displacing the stator blade in the circumferential groove. On the other hand, the gaps which are required for thermal expansion can be provided in sufficient size as a result, which makes the stator blade arrangement insensitive to thermal influences.

Since the assembly clearances and therefore the manufacturing tolerances can be increased on account of the compensating of the larger clearances by means of the tensioning screw, a cost advantage also results in the manufacture of the corresponding components.

In addition, as a result of the tensioning of the stator blade on the carrier structure, relative movements of the stator blades are blocked and consequently possible wear is reduced.

Moreover, the stator blades, on account of their clearance-free fastening, have a defined radial position, as a result of which the radial gaps between the free-standing airfoil tips of the stator blades and the rotor which lies opposite these airfoil tips can be set and produced narrower than previously. This reduces the radial gap losses, which occur in the flow medium, at the airfoil tips of free-standing stator blades during operation of the turbomachine, which increases the efficiency of the turbomachine.

So that the tensioning screw which is required for tensioning the stator blade does not project into the flow passage of the turbomachine, on one of the two oppositely disposed sides of the blade root, a shaped piece is arranged, which projects therefrom. The shaped piece in this case is arranged considerably closer to the underside of the blade root than to the surface of the platform. Provision is made in the shaped piece for a threaded hole in which the tensioning screw can be screwed. Since the shaped piece projects to the side, the threaded hole and the tensioning screw are particularly easily accessible for installation operations.

In order to provide a flow passage boundary of the turbomachine with as few component edges as possible, it is provided that the platform of that stator blade which is arranged directly adjacent to a stator blade in question covers the shaped piece, including the tensioning screw, of the stator blade in question. For this purpose, provision is made on the other of the two oppositely disposed sides of the blade root for at least one recess in a size which corresponds at least to the installation space of the shaped piece, including the tensioning screw which is screwed into it. By means of this measure, a flow passage boundary can locally be achieved by means of the top surfaces of the platforms of the blade root alone without additional components being required in the circumferential groove for covering the shaped piece, including the tensioning screw. Moreover, the tensioning screws are shielded from the flow medium by means of the platform of the adjacent stator blade and are therefore protected against its influences. This prevents corrosion and seizing of the tensioning screws in the thread of the hole.

Further advantageous developments are disclosed in the dependent claims.

The stator blade root is expediently of an inverted T-shaped design. According to a further advantageous development, the stator blade comprises two shaped pieces on the one side, with a threaded hole in each case. As a result of this, a tensioning of the stator blade can be carried out in which the tensioning force is created in each case close to the sidewalls of the circumferential groove and not in the middle between them, as in the case of a stator blade with only one shaped piece. This increases the security of the tensioning. Naturally, it is also conceivable for two threaded holes to be provided, with comparable spacing, in a correspondingly large shaped piece.

Naturally, the stator blade can also be formed as a stator blade segment which has two or more blade airfoils.

The turbomachine is preferably a compressor which is exposable to axial throughflow so that the stator blade is formed as a compressor stator blade or as a compressor stator blade segment.

According to an advantageous development of the stator blade arrangement, at least one of the stator blades has a locking device for absorbing blade root reaction forces in the circumferential direction. Previously each stator blade was customarily locked in such a way. On account of the now reliable stator blade which is tensioned with a comparatively large force, the number of previously used locking devices for absorbing blade root reaction forces can be reduced so that for example only every fourth or every third stator blade has to be locked for absorbing such forces.

According to another advantageous development, the carrier structure is formed as a stator blade carrier or as a turbomachine casing which can be split in half along its axial extent. This facilitates the insertion of stator blades in the circumferential groove. Also, the provision of a stator blade lock is avoided which otherwise in the case of a one-piece carrier structure would be necessary with a circumferential groove which would then be endless.

BRIEF DESCRIPTION OF THE DRAWINGS

Further advantages, features and characteristics of the invention are explained in more detail based on preferred exemplary embodiments and subsequent drawings. In the drawing.

DETAILED DESCRIPTION OF INVENTION

Figure 1:
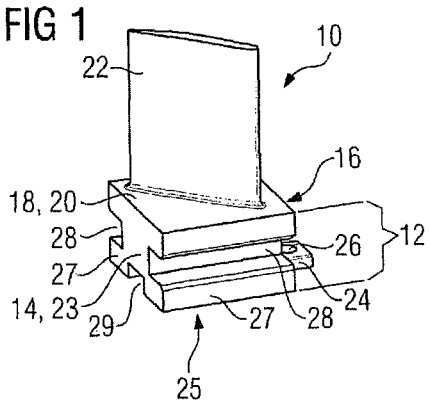
FIGS. 1, 2 show a stator blade according to the invention, according to a first development in different perspective views.
Figure 2:
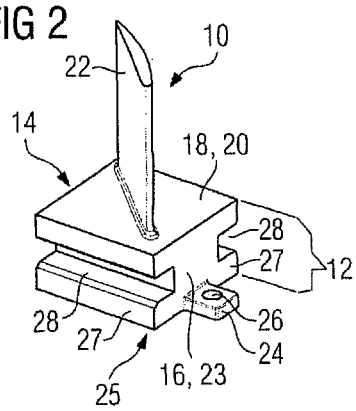

FIG. 1 and FIG. 2 show in perspective view, from different directions of view, a stator blade 10 according to the invention for a turbomachine. The stator blade 10 comprises a blade root 12 which has two oppositely disposed sides 14, 16. Between the two oppositely disposed sides 14, 16, a platform 18 is arranged, from the top surface 20 of which an aerodynamically curved blade airfoil 22, which extends transversely to it, projects in a free-standing manner.

On one (16) of the two sides 14, 16, a projecting shaped piece 24 is formed in the manner of a lug. The shaped piece 24 in this case is arranged in the middle close to an underside 25 of the blade root. In the shaped piece 24, there is a threaded hole 26, the thread axis of which is oriented perpendicularly to the plane of the top surface 20 of the platform 18.

On the other (14) of the two sides 14, 16, provision is made for a recess 29. The recess 29 of the stator blade 10 in question in this case is selected in its position and its size so that in the case of stator blades 10 abutting in a ring the shaped piece 24, or each shaped piece—including a tensioning screw which is arranged therein but not shown in FIG. 1 and FIG. 2—of a stator blade 10 which is directly adjacent to the stator blade 10 in question can be fully accommodated.

The stator blade 10, moreover, has two hooks 27 which project on a web 23 which connects the two sides 14, 16. Consequently, between hook 27 and platform 18, there is a slot 28 in each case for accommodating projections of the circumferential groove into which the stator blade 10 is to be inserted. The web 23 and the hooks 27 have an inverted T-shaped impression, whereupon the blade root 12 is also described as being an inverted T-shape.

The stator blades 10, which are butt-mounted in the circumferential groove, always butt against each other in such a way that the one side 16 of a first stator blade 10 lies opposite the other side 14 of a second stator blade 10 in a gapless manner as far as possible.

Figure 3:
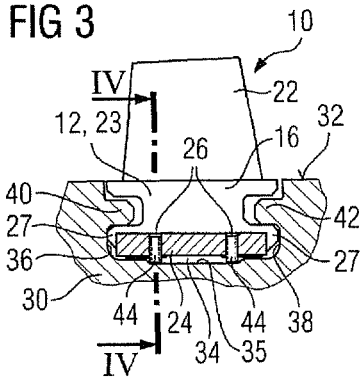
FIG. 3 shows the longitudinal section through a carrier structure and stator blade according to a second development.

FIG. 3 shows the longitudinal section through an annular carrier structure 30 which is part of a stator blade carrier or of a casing of the turbomachine which is exposable to axial throughflow. On its inner generated surface 32, provision is made for a circumferential groove 34 which extends in the circumferential direction. The circumferential groove 34 has two oppositely disposed sidewalls 36, 38 on which provision is made for projections 40, 42 for the form-fitting retention of the stator blade 10. The stator blade 10 which is shown in FIG. 3 differs from the stator blade 10 which is shown in FIG. 1 and FIG. 2 in that the shaped piece 24 which is arranged on the one side 16 extends almost over the entire width of the blade root 12 or of the circumferential groove 34 and in that provision is made for altogether two threaded holes 26 which are not arranged in the middle between the sidewalls 36, 38 of the circumferential groove 34, but close to the sidewall.

A tensioning screw 44 is screwed in the threaded holes 26 in each case. The tensioning screw 44 can be formed for example as a grub screw or even as a common screw with a screw head. The end of the tensioning screw 44 is supported on the bottom 35 of the circumferential groove 34 and at the same time presses the hooks 27 which are arranged on the blade root 12 onto the projections 40, 42 of the circumferential groove 34, as a result of which the stator blade 10 lies in a fixed pretensioned state in the radial direction of the turbomachine which is exposable to axial throughflow.

Figure 4:
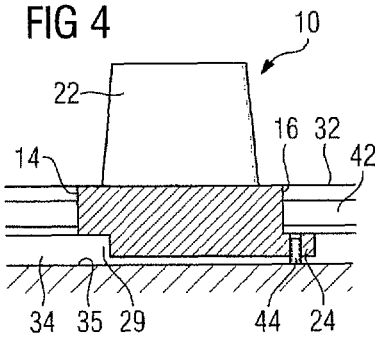
FIG. 4 shows the cross section through the development according to FIG. 3.

FIG. 4 shows the cross section through FIG. 3 according to the line of intersection IV-IV, wherein identical features in FIG. 4 are also provided with identical designations. It clearly emerges from FIG. 4 that the shaped piece 24 projects on the side 16 and in this case is a part of the underside 25 of the blade root. Also to be seen in FIG. 4 is the recess 29 which is on the opposite side 14 for accommodating a shaped piece 24 of an adjacent stator blade 10, including a tensioning screw 44 which is screwed into it. The recess 29 is also arranged on the underside 25 of the blade root, corresponding to the shaped piece 24.

Figure 5:
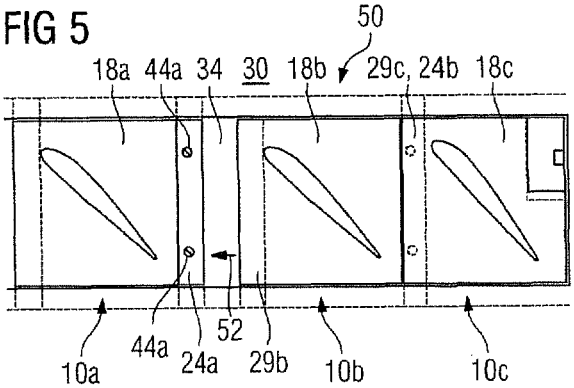
FIG. 5 shows the development of a circumferential groove which is arranged in a carrier structure, with stator blades arranged therein.

FIG. 5 shows a part of the development of a stator blade arrangement 50 with carrier structure 30 and circumferential groove 34. In the following figure description and in this figure, the designations of the features which are associated with a first stator blade 10*a* are expanded by the suffix a, the designations of the features which are associated with a second stator blade 10*b* are expanded by the suffix b, and the designations of the features which are associated with a third stator blade 10*c* are expanded by the suffix c. The first stator blade 10*a* is already positioned at its specified location and by means of two grub screw-like tensioning screws 44*a* is tensioned in a fixed manner in the circumferential groove 34. For the further equipping of the stator blade arrangement 50 with stator blades, two second and third stator blades 10*b*, 10*c* are already threaded in the circumferential groove 34. After tensioning the first stator blade 10*a*, the second stator blade 10*b*, which is directly adjacent to it, is displaced in the circumferential direction, i.e. in the direction of the arrow 52, until its platforms 18*a*, 18*b* butt against each other. In the process, the shaped piece 24*a* of the first stator blade 10*a* is then arranged in the recess 29*b* of the second stator blade 10*b* so that from the flow passage point of view the platform 18*b* of the second stator blade 10*b* completely covers the shaped piece 24*a* of the first stator blade 10*a*. Strictly speaking, the top surface 20*b* of the platform 18*b* covers the recess 29*b* in radial projection. Next, the second stator blade 10*b* is fastened in the corresponding position by means of further tensioning screws. Consequently, the third stator blade 10*c* can be slid over the shaped piece 24*b* of the second stator blade 10*b* so that its tensioning screws are also concealed by the platform 18*c* of the third stator blade 10*c*. By continued threading and tensioning of further stator blades 10 of the stator blade ring, a complete stator blade ring for a turbomachine which is exposable to axial throughflow can be assembled, wherein all the stator blades 10 are then pressed with a defined pretension on the projections 40, 42 of the retaining groove 34.

Figure 6:
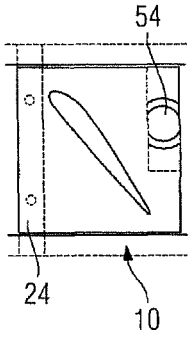
FIG. 6 shows the plan view of a stator blade which is arranged in a circumferential groove, including a locking device for absorbing blade root reaction forces.

The stator blades 10, moreover, are further secured for absorbing blade root reaction forces according to FIG. 6. In the bottom 35 of the retaining groove 34, there is a throughhole for this purpose, into which a further screw 54, with a dog point, can be screwed from the rear side of the carrier structure 30, the dog point engaging in a recess, which corresponds to it, on the underside of the blade root 12 of the stator blade 10.

The invention is not limited to the developments of stator blades 10 which are shown in FIGS. 1, 2 and 3. Naturally, it is possible to also provide on the one side 16 two shaped pieces 24, these then being off-center, with a threaded hole 26 in each case. The other side 14 of such a stator blade 10 then has one or two recesses 29 for accommodating the corresponding shaped pieces 24.

In all, with the invention a stator blade 10 and a stator blade arrangement 50 for a turbomachine which is exposable to axial throughflow, especially a compressor, is disclosed, in which each stator blade 10 is retained via a fixed clamping in a circumferential groove 34. For the fixed clamping, provision is made on one side 16 of the blade root 12 for a projecting shaped piece 24 with a threaded hole 26 into which a tensioning screw 44, which is supported on the bottom 35 of the circumferential groove 34, can be screwed. A particular advantage of the invention is that in the stator blade ring both the shaped piece 24 and the tensioning screw 44 which is screwed into it are completely covered by the platform 18 of a stator blade 10 which is adjacent thereto, so that the interengaging thread of threaded hole 26 and tensioning screw 44 is shielded by the top surface 20 of the platform 18 against the operating medium which flows in the flow passage of the turbomachine. The shielding prevents corrosion and seizing of the tensioning screw 44, which reliably ensures removal of the stator blades 10 from the circumferential groove 34 even after longer periods of operation.

The invention claimed is:

1. A stator blade for a turbomachine which is exposable to an axial throughflow, comprising:

a blade root, including two oppositely disposed sides and also including a platform;

a blade airfoil which is arranged on the platform; and a projecting shaped piece, wherein the blade root on a first side of the two sides includes a first projecting shaped piece in which provision is made for a threaded hole for a radial tensioning of the stator blade in a circumferential groove of a carrier structure of a turbomachine using a first tensioning screw which is screwed into the threaded hole and supported on a bottom of the circumferential groove, and wherein the blade root on a second side of the two sides includes a recess for accommodating a second projecting shaped piece of an adjacent stator blade, including a second tensioning screw which is screwed into the second projecting shaped piece.

2. The stator blade as claimed in claim 1, wherein the blade root includes an inverted T-shaped design.

3. The stator blade as claimed in claim 1, wherein the stator blade comprises one projecting shaped piece including two threaded holes in the one projecting shaped piece.

4. The stator blade as claimed in claim 1, wherein the projecting shaped piece is arranged comparatively closer to an underside of the blade root than to a surface of the platform.

5. The stator blade as claimed in claim 1, wherein the stator blade is formed as a compressor stator blade of a compressor which is exposable to the axial throughflow.

6. A stator blade arrangement for a turbomachine, comprising:

an annular carrier structure;

a plurality of stator blades, each stator blade, comprising:

a blade root, including two oppositely disposed sides and also including a platform, a blade airfoil which is arranged on the platform, and a projecting shaped piece, wherein the blade root on a first side of the two sides includes a first projecting shaped piece in which provision is made for a threaded hole for a radial tensioning of the stator blade in a circumferential groove of a carrier structure of a turbomachine using a first tensioning screw which is screwed into the threaded hole and supported on a bottom of the circumferential groove, and wherein the blade root on a second side of the two sides includes a recess for accommodating a second projecting shaped piece of an adjacent stator blade, including a second tensioning screw which is screwed into the second shaped piece, wherein on an inner generated surface of the annular carrier structure, a provision is made for the circumferential groove in which the plurality of stator blades, which are retained using a form fit, are seated in a butt-mounted manner, wherein each stator blade is tensioned in the circumferential groove using the tensioning screw, and wherein the first projecting shaped piece, including the first tensioning screw, is fully covered by the platform of a second stator blade which is directly adjacent to a first stator blade.

7. The stator blade arrangement as claimed in claim 6, wherein at least one of the plurality of stator blades includes a locking device for absorbing blade root reaction forces in a circumferential direction.

8. The stator blade arrangement as claimed in claim 6, wherein the carrier structure is split in half.

9. The stator blade arrangement as claimed in claim 6, wherein the turbomachine is a compressor.

10. The stator blade arrangement as claimed in claim 6, wherein the blade root includes an inverted T-shaped design.

11. The stator blade arrangement as claimed in claim 6, wherein the stator blade comprises one projecting shaped piece including two threaded holes in the one projecting shaped piece.

12. The stator blade arrangement as claimed in claim 6, wherein the projecting shaped piece is arranged comparatively closer to an underside of the blade root than to a surface of the platform.

13. The stator blade arrangement as claimed in claim 6, wherein the stator blade is formed as a compressor stator blade of a compressor which is exposable to the axial throughflow.

* * * * *